US005222555A

United States Patent [19]

Bridges

[11] Patent Number: 5,222,555

[45] Date of Patent: Jun. 29, 1993

[54] EMERGENCY CASING HANGER SYSTEM

[75] Inventor: Charles D. Bridges, Cypress, Tex.

[73] Assignee: ABB Vetco Gray Inc., Houston, Tex.

[21] Appl. No.: 807,009

[22] Filed: Dec. 13, 1991

[51] Int. Cl.[5] ..... E21B 33/04

[52] U.S. Cl. ..... 166/208; 166/217; 285/141; 285/144; 285/323

[58] Field of Search ..... 166/217, 208, 214, 207; 285/322, 323, 141, 144, 145, 23; 175/423

[56] References Cited

U.S. PATENT DOCUMENTS

| | | | |
|---|---|---|---|
| 2,624,413 | 1/1953 | Mueller et al. | 175/423 X |
| 2,880,806 | 4/1959 | Davis | 166/217 X |
| 3,179,448 | 4/1965 | Jones | 285/146 |
| 3,437,356 | 4/1969 | Todd et al. | 175/423 X |
| 4,465,133 | 8/1984 | Bridges | 166/208 |
| 4,678,209 | 7/1987 | Guice | 285/144 |
| 4,790,379 | 12/1988 | Vanderford, Jr. | 166/208 |
| 4,982,795 | 1/1991 | King | 166/217 X |

*Primary Examiner*—Hoang C. Dang
*Attorney, Agent, or Firm*—James E. Bradley

[57] ABSTRACT

An emergency casing hanger can be lowered over casing collars and into a wellhead housing to support a string of casing. The casing hanger has a slip bowl which is slotted so that it can be radially expanded to insert over the casing collar. Slips are carried in the interior of the bowl for gripping the casing once the slip bowl is in position. The running tool has an inner sleeve that holds the slips in a retracted position and holds the slip bowl in an expanded position until the slip bowl clears the collar. Once the running tool has been removed, a honing tool is then lowered over the casing. The honing tool has honing stones mounted in a housing and biased inward for smoothing the exterior of the casing to receive a seal.

8 Claims, 3 Drawing Sheets

EMERGENCY CASING HANGER SYSTEM

BACKGROUND OF THE INVENTION

1. Field of the Invention

This invention relates in general to supporting a casing in a wellhead, and in particular to a system for supporting the casing under an emergency basis when the casing is stuck.

2. Description of the Prior Art

Wellheads of the type concerned herein have a wellhead housing at the top of the well. After drilling the well to the desired depth, a string of casing is lowered into the well. A casing hanger secured to the upper end of the casing lands on a landing shoulder in the wellhead. Cement is pumped down the casing to flow up the annulus around the casing to cement it in place. The well may be subsequently drilled deeper or completed with tubing.

Occasionally, an emergency condition will exist. This occurs when the casing becomes stuck in that it cannot move downward or upward. A standard casing hanger secures by threads to the upper end of the casing, and cannot be employed in its normal manner because it would be above the landing shoulder in the wellhead housing.

There are various methods and devices used in this situation. Typically they involve cementing the casing, then cutting the casing off in the wellhead housing. Then the operator inserts slips over the casing and sets them on the landing shoulder in the wellhead housing. The operator tensions the casing. Then, a seal or pack-off is placed between the wellhead housing and the exterior of the casing.

One disadvantage of the prior art method is that it may result in the blowout preventer being inoperative before the casing hanger seal is installed. The blowout preventer mounts above the wellhead housing and seals to the exterior of the casing. Normally the operator must cut off the casing within the wellhead, requiring removal of the blowout preventer. A danger exists that a blowout could occur.

It has not been possible to place the slips over the casing prior to cutting the casing because of the existence of a casing collar above the landing shoulder in the wellhead housing. The casing collar is of a larger diameter than the inner diameter of the slip assemblies utilized previously.

Also, when sealing, the seals need to seal on the rough exterior of the casing. If metal-to-metal seals are employed, this is very difficult. Metal seals seal best against very smooth surfaces.

SUMMARY OF THE INVENTION

In this invention, the slip assembly may be installed before the casing is cut. The slip assembly has an expansible bowl and slips in its interior. A running tool will expand the bowl radially as it is being lowered. This enables the slip bowl to be lowered past the casing collar and into the wellhead. Once past the casing collar, the running tool is actuated to allow the bowl to contract. Once in place, the running tool is removed. The slips slide inward to a gripping position to support the casing.

A honing tool may be lowered over the casing and placed on top of the slip bowl. The honing tool has a plurality of honing stones. A resilient member urges the honing stones inward. The operator rotates the honing tool to smooth the surface of the casing above the slip bowl. Then, a seal may be set and the casing cut.

DETAILED DESCRIPTION OF THE INVENTION

Figure 2:
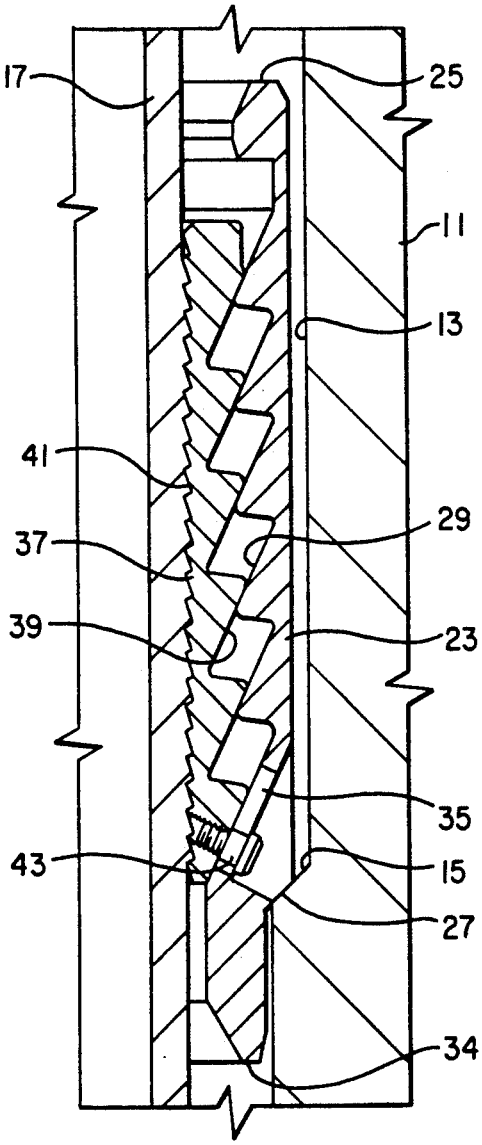
FIG. 2 is an enlarged quarter sectional view of the slip assembly of FIG. 1.

Referring to FIG. 2, the well has a wellhead housing 11 which is a large tubular member. Wellhead housing 11 has an axial bore 13. A landing shoulder 15 locates inside bore 13, and faces upward and outward. During drilling, a blowout preventer (not shown) will be mounted above the wellhead housing 11.

Figure 1:
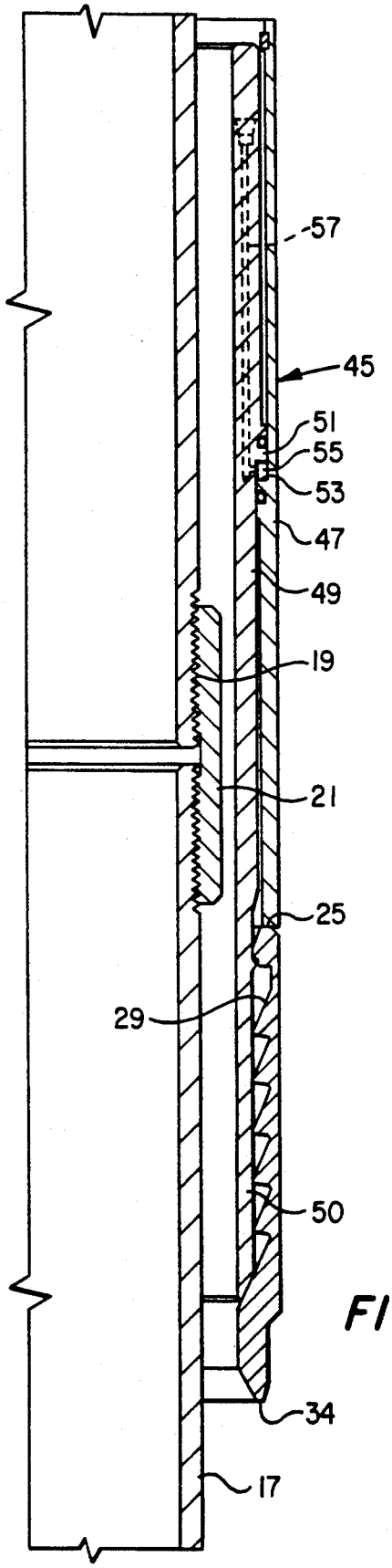
FIG. 1 is a quarter sectional view illustrating a slip assembly and running tool being lowered past a casing collar.

Referring to FIG. 1, a string of casing 17 extends through the blowout preventer and wellhead housing 11 into the well. The string of casing 17 is made up of sections of casing, each about 40 feet long, each having a threaded end 19 on one end and a casing collar 21 on the opposite end. In FIG. 1, the casing 17 is shown to be stuck in a position in which it will not proceed downward or upward. This results in a collar 21 being located above the landing shoulder 15 and possibly below the blowout preventer.

The slip assembly of this invention includes a slip bowl 23. Slip bowl 23 is a tubular member having an upper rim 25 and an external downward facing landing shoulder 27. Landing shoulder 27, as illustrated in FIG. 2, is conical and at the same angle as wellhead housing landing shoulder 15 for landing on wellhead housing landing shoulder 15. A plurality of conical surfaces 29 are formed in the interior of slip bowl 23.

Figure 3:
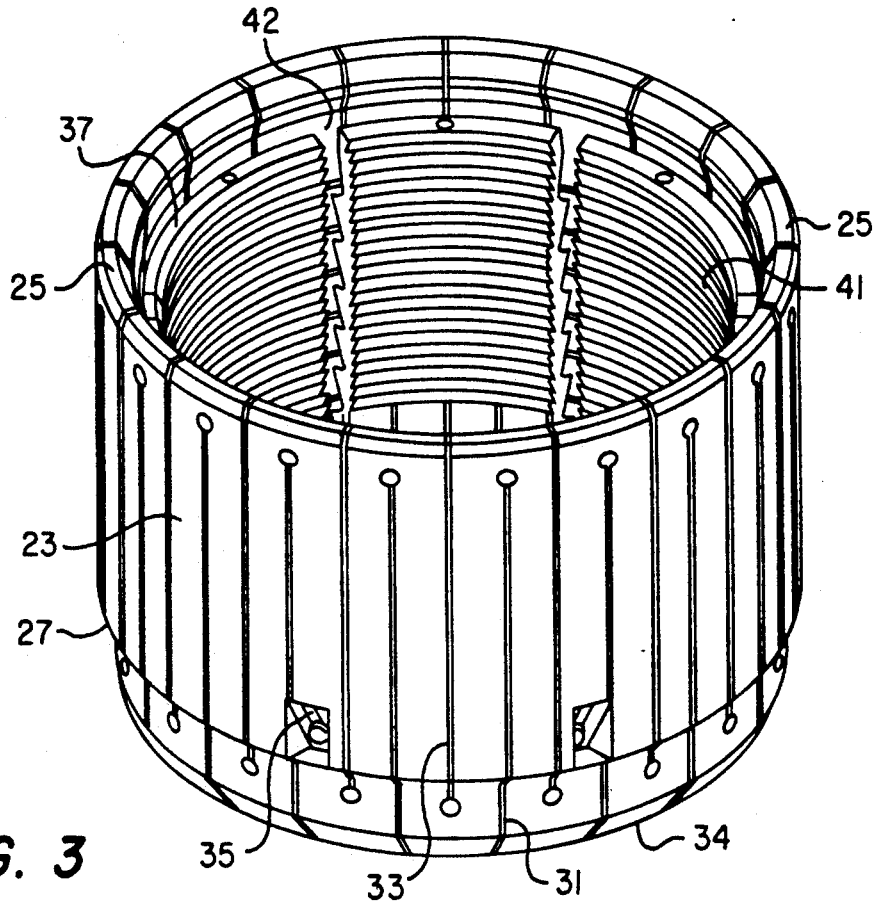
FIG. 3 is a perspective view of the slip assembly of FIG. 1.

As shown in FIG. 3, slip bowl 23 contains expansion means for allowing slip bowl 23 to expand to clear collar 21, then contract after clearing collar 21. The expansion means comprises a plurality of lower and upper slots 31, 33. Slots 31, 33 form a serpentine body for the slip bowl 23. Lower slots 31 extend through the lower rim 34 and terminate a selected distance below the upper rim 25. Upper slots 33 extend through the upper rim 25 and terminate a selected distance above the lower rim 34. Slots 31 and 33 alternate with each other. This results in a continuous body that can be expanded resiliently, and allowed to contract.

When in a relaxed position, the inner diameter of slip bowl 23 at its minimum point will be less than the outer diameter of casing collar 21. When expanded to a maximum position, the inner diameter of slip bowl 23 at its minimum will be greater than the outer diameter of casing collar 21. Slip bowl 23 also has a plurality of elongated apertures 35 that extend through its wall and are spaced circumferentially around slip bowl 23.

Referring to FIGS. 2 and 3, a set of slips 37 are carried inside slip bowl 23. Each of the slips 37 has a back or exterior with conical surfaces 39 that mate with the slip bowl conical surfaces 23. Each of the slips 37 has an interior face with rows of grooves or teeth 41 for gripping the exterior of casing 17.

The slips 37 are separated from each other by clearances 42 (FIG. 3). The slips 37 will move from a retracted position inward to a gripping position shown in FIG. 2. When moving inward, the slips 37 slide downward by gravity on the slip bowl conical surfaces 39. A screw 43 locates in aperture 35 for retaining the slips 37 in the slip bowl 23. Screw 43 will slide in the elongated aperture 35 to allow the slips 37 to move inward and downward from the retracted position. When moving to the gripping position, the clearances 42 will decrease in width, with the slips 37 moving closer to each other.

Referring to FIG. 1, a running tool 45 runs the slip bowl 23 and slips 37. Running tool 45 is a tubular member having an outer sleeve 47 and an inner sleeve 49. Inner sleeve 49 is cylindrical and has a plurality of spaced apart fingers 50 depending downward. Each finger 50 will located in one of the clearances 42 between each of the slips 37. Each of the slips 37 locates in a slot (not shown) between each finger 50. When inserted in slip bowl 23, the fingers 50 extend from the upper rim 25 to the lowermost conical surface 29. When inserted, the fingers 50 hold the slips 37 in a spaced apart retracted position, preventing the slips 37 from moving downward and inward to the gripping position.

The outer diameter of the inner sleeve 49, measured around fingers 50, is greater than the inner diameter of the slip bowl 23 when slip bowl 23 is in a relaxed position. Consequently, when inserted, the fingers 50 will expand the diameter of the slip bowl 23. Also, the inner diameter of the inner sleeve 49 and fingers 50 is greater than the outer diameter of collar 21. When inserted, the inner diameter of slip bowl 23 directly below the fingers 50 will be substantially the same inner diameter as fingers 50. This enables the running tool 45 with the slip bowl 23 and slips 37 to be inserted over the collar 21.

The inner sleeve 49 and fingers 50 will move up and down relative to the outer sleeve 47. Inner sleeve 49 has an annular band or piston 51 on its exterior. Piston 51 has a seal that seals to the interior of outer sleeve 47. A shoulder 53 faces upward on the interior of outer sleeve 47. A space between piston 51 and shoulder 53 defines a chamber 55. A passage 57 connects chamber 55 to a source of hydraulic liquid under pressure. Applying hydraulic pressure to chamber 55 will cause the inner sleeve 49 to move upward relative to the outer sleeve 47.

In operation, if the casing string 17 becomes stuck, the operator will cement the casing in place. Before the cement sets completely, the operator will assemble running tool 45 with the slip bowl 23 as shown in FIG. 1. The inner sleeve 49 will be pushed downward relative to the outer sleeve 47. The inner sleeve fingers 50 will extend downward into the clearances 42 to retain the slips 37 in a retracted position. The inner sleeve fingers 50 will radially expand the slip bowl 23 to a diameter greater than the outer diameter of collar 21. The lower portion of the inner sleeve 49 will thus hold the slips 37 in the retracted position and also hold the slip bowl 23 in an expanded position.

The operator then inserts the running tool 45 over the upper end of the string of casing 17 and through the blowout preventer (not shown). Once the slip bowl 23 clears collar 21, the operator then applies hydraulic fluid pressure to the chamber 55. This causes the inner sleeve 49 to move upward relative to the outer sleeve 47. The resiliency of the slip bowl 23 causes it to contract from the radially expanded position once the inner sleeve 49 has been removed. In the contracted position, the inner diameter of the slip bowl 23 is less than the outer diameter of the collar 21. In the contracted position, the outer diameter of slip bowl 23 is less than the inner diameter of bore 13. While expanded, the outer diameter of slip bowl 23 will likely be greater than the inner diameter of bore 13.

After moving the running tool sleeve fingers 50 upward, the operator lowers the slip bowl 23 until its running shoulder 27 lands on the wellhead housing running shoulder 15. The operator will retrieve the running tool 45. Without the fingers 50 to hold them, the slips 37 will have moved downward by gravity. The conical surfaces 29 cause the slips to move inward until the teeth 41 contact the exterior of casing 17. The operator then will engage the upper end of casing 17 with drilling rig blocks and pull an upward force. The upper end of casing 17 adjacent teeth 41 will move upward as tension is applied. The operator then slacks off. The teeth 41 will grip tightly and hold the casing 17 in tension.

Figure 5:
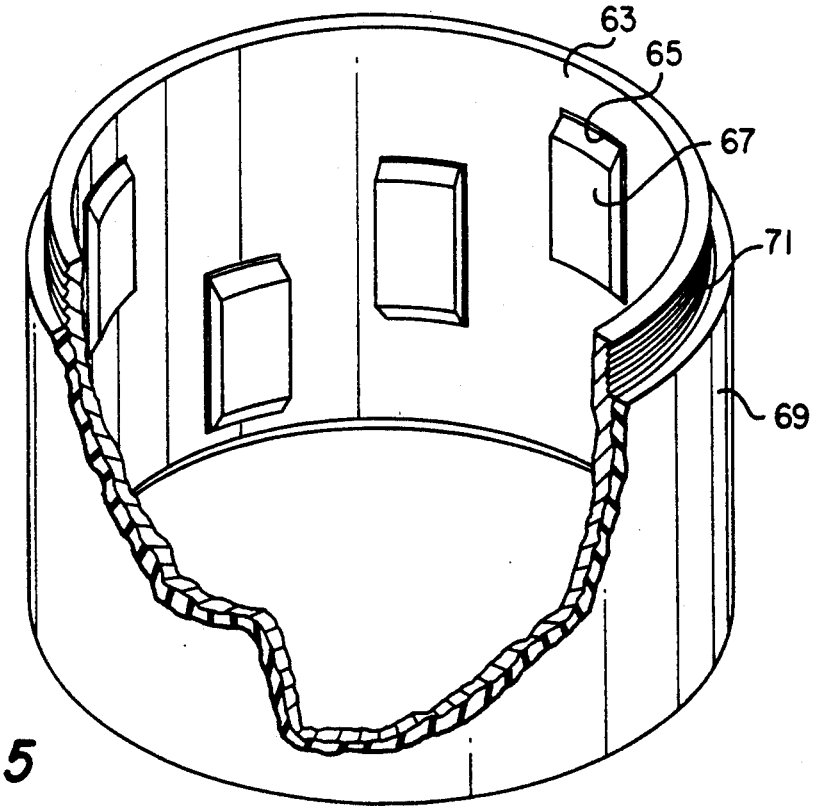
FIG. 5 is a perspective view, partially broken away, of portions of the honing tool of FIG. 4.
Figure 4:
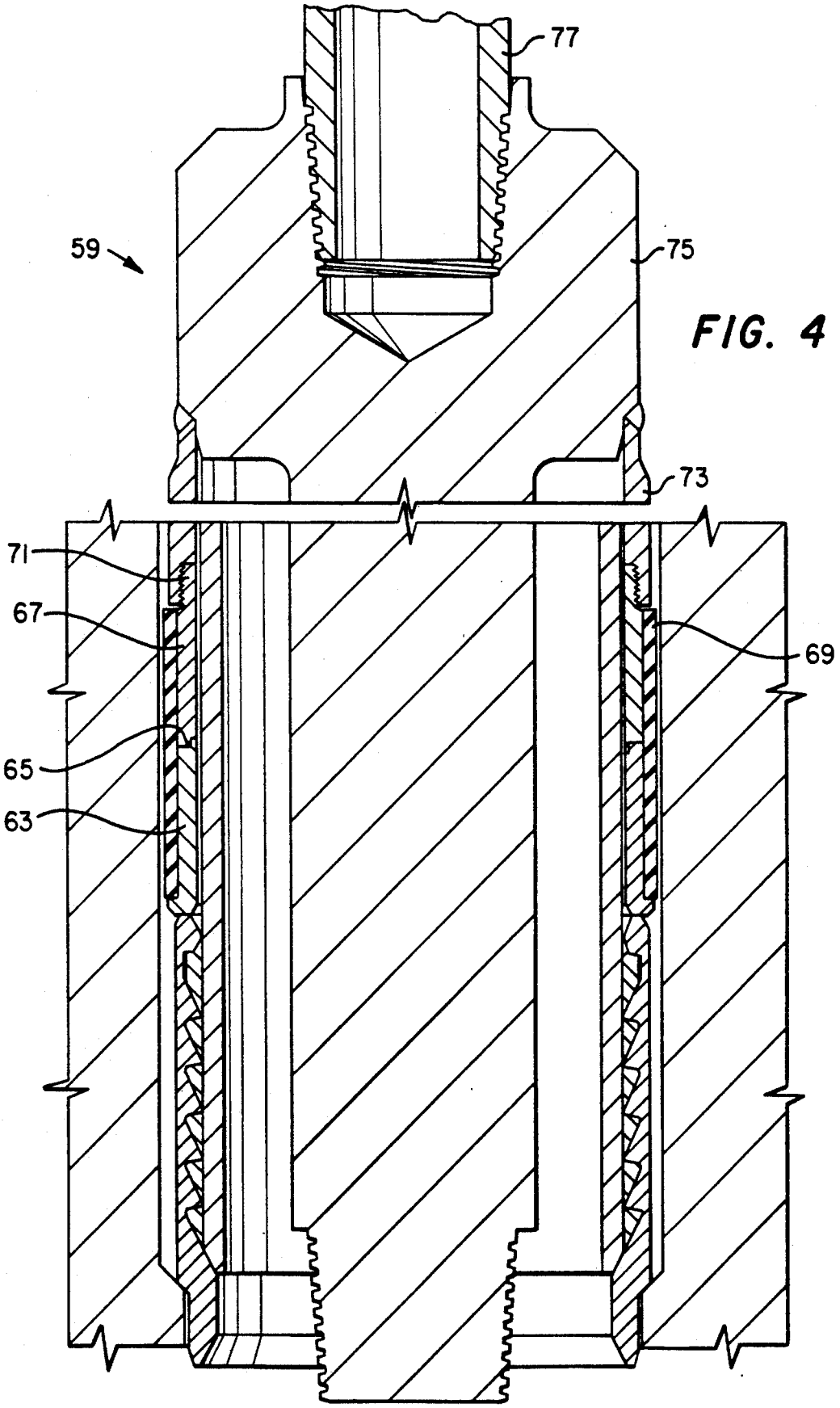
FIG. 4 is a half sectional view illustrating a honing tool constructed in accordance with this invention shown placed on the slip assembly of FIG. 1.

In the preferred method, prior to installing a seal (not shown) between casing 17 and wellhead housing bore 13, a honing tool 59 is employed, as shown in FIGS. 4 and 5. Honing tool 59 will smooth the exterior of casing 17 directly above slip bowl 23. Honing tool 59 has a cage 63 that is cylindrical and sized to fit over casing 17. If the operator wishes to delay cutting the casing 17 until after the seal is installed, the cage 63 will be dimensioned to also pass through the blowout preventer and over casing collar 21.

Cage 63 has a plurality of windows 65. As shown in FIG. 5, windows 65 are spaced circumferentially apart. Some of the windows 65 are positioned at lower places on cage 63 than others. A honing stone 67 locates moveably in each window 65. Each honing stone 67 is capable of protruding into the interior of cage 63 an appreciable distance and of being pushed outward in each window 65 a selected amount. A lip (not shown) around each window 65 and a shoulder (not shown) around each honing stone 67 prevents the honing stones 67 from falling into the interior of cage 63.

A resilient means is employed to urge the honing stones 67 inward. The resilient means in the preferred embodiment is an elastomeric sleeve 69. Elastomeric sleeve 69 extends over the exterior of cage 63. The honing stones 67 have a greater radial thickness than the radial thickness of cage 63. As a result, the contact of elastomeric sleeve 69 with the back of each honing stone 67 pushes the face of each honing stone 67 forward into tight contact with the casing 17.

Threads 71 are formed on the upper end of cage 63. A tubular adapter 73 connects threads 71 to a mandrel 75. Mandrel 75 receives a pipe 77. Pipe 77 will be connected to a rotary power source, which could be air, hydraulic, or electric motors.

In the operation of the honing tool 59, the user inserts the cage 63 into the clearance between the casing 17 and wellhead housing bore 13. The user then rotates mandrel 75. The sleeve 69 will bias the honing stones 67 inward. The stones 67 will smooth the exterior of casing 17. Once a desired smoothness has been achieved, the operator pulls the honing tool 59 from the wellhead housing 11.

The operator then positions and energizes a seal (not shown) above the slip bowl 23. The seal may be of various conventional types. The seal seals between the casing 17 and wellhead housing bore 13. The casing 17 may then be cut.

The invention has significant advantages. The emergency casing system enables an operator to install slips over a casing collar and into a wellhead housing. This allows the operator to delay cutting the casing until the slips have been already installed. The honing tool will smooth the exterior of the casing prior to receiving a seal.

While the invention has been shown in only one of its forms, it should be apparent to those skilled in the art that it is not so limited, but is susceptible to various changes without departing from the scope of the invention.

I claim:

1. An apparatus for supporting a string of casing in a wellhead housing of a type having a bore with an axis and a landing shoulder formed therein, the apparatus comprising in combination:

a slip bowl having a landing shoulder for landing on the landing shoulder of the wellhead housing, the slip bowl having a plurality of conical surfaces in its interior and being an integral annular member, the slip bowl having expansion means for allowing the slip bowl to expand and contract radially during installation to allow the slip bowl to pass over a casing collar, the expansion means comprising a plurality of axially extending spaced apart slots in the slip bowl; and a slips carried in the interior of the slip bowl on the conical surfaces, the slips having gripping teeth for gripping the casing and being movable between retracted and gripping positions relative to the slip bowl.

2. The apparatus according to claim 1 wherein the slips comprises a plurality of separate slip segments.

3. The apparatus according to claim 1 wherein the slips comprises a plurality of separate slip segments, each being slidable on the conical surfaces between the retracted and expanded positions.

4. An apparatus for supporting a string of casing in a wellhead housing of a type having a bore with an axis and a landing shoulder formed therein, the apparatus comprising in combination:

a slip bowl having a landing shoulder for landing on the landing shoulder of the wellhead housing, the slip bowl having a plurality of conical surfaces in its interior, the slip bowl having a plurality of axially extending spaced apart slots to allow the slip bowl to expand and contract radially during installation to allow the slip bowl to pass over a casing collar;

a slips carried in the interior of the slip bowl on the conical surfaces, the slips having gripping teeth for gripping the casing and being movable between retracted and gripping positions relative to the slip bowl; and wherein the slip bowl has an upper rim and a lower rim, and wherein the slots alternate with each other, with half of the slots extending from the upper rim to a point above the lower rim and the other half of the slots extending from the lower rim to a point below the upper rim.

5. An apparatus for supporting a string of casing in a wellhead housing of a type having a bore with an axis and a landing shoulder formed therein, the apparatus comprising in combination:

a slip bowl having an external landing shoulder for landing on the landing shoulder of the wellhead housing, the slip bowl having a plurality of conical surfaces in its interior and being an integral annular member;

expansion means comprising a plurality of axially extending spaced apart slots for allowing the slip bowl to resiliently expand and contract radially during installation to allow the slip bowl to be inserted over a casing collar; and slip means carried in the interior of the slip bowl on the conical surfaces and having gripping teeth for gripping the casing, the slip means being movable between retracted and gripping positions relative to the slip bowl.

6. The apparatus according to claim 5 wherein the slip means comprises a plurality of separate slip segments, each being slidable on the conical surfaces between the retracted and expanded positions.

7. An apparatus for supporting a string of casing in a wellhead housing of a type having a bore with an axis and a landing shoulder formed therein, the apparatus comprising in combination:

a slip bowl having an external landing shoulder for landing on the landing shoulder of the wellhead housing, the slip bowl having a plurality of conical surfaces in its interior;

expansion means for allowing the slip bowl to resiliently expand and contract radially during installation to allow the slip bowl to be inserted over a casing collar;

slip means carried in the interior of the slip bowl on the conical surfaces and having gripping teeth for gripping the casing, the slip means being movable between retracted and gripping positions relative to the slip bowl; and wherein the expansion means comprises a plurality of axially extending slots formed in the slip bowl, spaced apart and alternating with each other to define a serpentine body for the slip bowl.

8. An apparatus for supporting a string of casing in a wellhead housing of a type having a bore with an axis and a landing shoulder formed therein, the apparatus comprising in combination:

a tubular slip bowl having a landing shoulder for landing on the landing shoulder of the wellhead housing, the slip bowl having an upper rim, a lower rim, and a plurality of conical surfaces in its interior, the slip bowl having a plurality of axially extending spaced apart slots to allow the slip bowl to expand and contract radially during installation, the slots alternating with each other, with one of the slots extending from the upper rim to a point above the lower rim and a next one of the slots extending from the lower rim to a point below the upper rim; and a set of slips carried in the interior of the slip bowl on the conical surfaces, each of the slips having gripping teeth for gripping the casing and being slidable on the conical surfaces between retracted and gripping positions relative to the slip bowl.

* * * * *